US005881763A

United States Patent [19]

Angelos

[11] Patent Number: 5,881,763

[45] Date of Patent: Mar. 16, 1999

[54] SYSTEM FOR DISTRIBUTING FLUID FROM A SINGLE SOURCE TO MULTIPLE LOCATIONS

[76] Inventor: Jeffrey S. Angelos, 20 Perry St., Stoughton, Mass. 02072

[21] Appl. No.: 741,865

[22] Filed: Sep. 26, 1996

[51] Int. Cl.[6] ..... F16K 49/00

[52] U.S. Cl. ..... 137/340; 137/883; 237/56

[58] Field of Search ..... 237/56, 62, 65; 137/340, 883

[56] References Cited

U.S. PATENT DOCUMENTS

| | | | |
|---|---|---|---|
| 461,282 | 10/1891 | Searle | 237/62 |
| 1,531,808 | 3/1925 | Parkinson | 137/340 |
| 2,122,560 | 7/1938 | De Florez | 137/340 |
| 2,224,929 | 12/1940 | Rose et al. | 237/56 |
| 3,202,356 | 8/1965 | Gardner et al. | 237/65 |
| 3,937,275 | 2/1976 | Boisseau | 237/56 |
| 4,570,677 | 2/1986 | Roxton et. al | 137/883 |

*Primary Examiner*—A. Michael Chambers
*Attorney, Agent, or Firm*—Hale and Dorr LLP

[57] ABSTRACT

A manifold system for distributing fluid from a single source to multiple locations is shown and described. The manifold system receives a single source of a fluid, such as water, which then is used for multiple purposes. The manifold system has an outlet structure to the provide water at a desired pressure to the pressure vessel for make-up feedwater, a structure that includes a mixer that provides hot water at a desired temperature range, an outlet structure that provides water at a predetermined pressure to water heating system, which may include a heating coil that provides an input to the mixer, and an outlet structure that includes a safety device that monitors the pressure in the manifold. The mixer receives as an input the hot water from the outlet of the heating coil. The hot water from the heating coil is mixed with cold water from within the manifold in the correct proportions to produce hot water within a desired temperature range. The outlet structure that provides make-up feedwater at a desired pressure to the pressure vessel includes an in-line member to prevent the output flow of water in that line from backflowing and an in-line pressure control member to control the pressure of the water output from this output structure.

28 Claims, 4 Drawing Sheets

SYSTEM FOR DISTRIBUTING FLUID FROM A SINGLE SOURCE TO MULTIPLE LOCATIONS

FIELD OF THE INVENTION

The present invention relates to systems that are used for distributing a fluid from a single source to multiple locations. More specifically, the present invention relates to a manifold system that is used to distribute to multiple locations a fluid, such as water, that is from a single source.

BACKGROUND OF THE INVENTION

In the past, there has been various types of boiler systems that have been used to provide heat to commercial and residential buildings. One of the main types is a closed-loop system. A closed-loop system includes a pressure vessel that is used to generate the steam that is later employed to effect heating. In the simplest form, a closed-loop system will have a steam outlet that will provide steam to the apartments or floors of a commercial building, or the rooms of a residence. The steam is provided to a heat exchanger of some type, such as a radiator, convector, baseboard unit, radiant panel, or a fan-driven heater. Once the heat is removed from the steam, it will condense and be returned to the pressure vessel where the cycle will be repeated. The condensate that is formed becomes the feedwater that will be used for the continued generation of steam.

The essentials of steam generation are to have a furnace for the combustion of fuel for the release of heat, a pressure vessel in which the boiler feedwater is raised to the boiling temperature, evaporated into steam, and, if desired, superheated beyond the saturation temperature, and an outlet for the steam. The pressure vessel also has a connection to a line that provides make-up feedwater that replaces the feedwater that is lost. All systems lose some amounts of feedwater in operation that has to be replaced. If it is not replaced, eventually the pressure vessel will run dry and be damaged. There are a number of methods to ensure that this does not happen, including, but not limited to, feedwater level sensors, sight tubes, and the like.

The general boiler system that has been discussed may serve as the basis of a heating system for a commercial or residential building, or it may be part of a heating and cooling system of such buildings. Since the types of systems just discussed are closed-loop systems, the hot water that is part of the boiler feedwater/steam thermocycle is not available for use as a hot water supply to the commercial or residential buildings. Hot water for this purpose has to be supplied by another source.

Hot water that is to be supplied to commercial or residential buildings may be generated in a number of ways. For example, there can be single hot water heaters for apartments (or houses) or there can a central hot water generating station that will supply all of the hot water needs. It has been found, however, that it may not be practical to have individual hot water heaters in each apartment. Moreover, even in residential housing, the desire may not be to have an individual hot water heater because of the space needed to house it. In these cases, some type of centralized system that can make use of the boiler heating or heating/cooling system to provide hot water without affecting the feedwater or condensate that exist in the boiler system is described.

One method of providing hot water that uses the boiler system without affecting the feedwater is to have a coil of tubular material passing inside the pressure vessel. The tubular material is preferably a coil of copper tubing that has an inlet that receives water from the feed line and an outlet that provides hot water that may be used as a hot water supply for a commercial or residential building. Within the pressure vessel, the exterior surface of the coil of copper tubing may be exposed to the feedwater only, steam only, or both.

As the water fed into the inlet of the copper tubing progresses to the outlet, heat is transferred from the feedwater or steam to the copper tubing, which in turn, transfers the heat to water in the copper tubing. The temperature of the water leaving at the outlet of the copper tubing will depend on the amount of heat transferred to the water.

In the past, there has been separate lines to supply make-up feed water to the pressure vessel and to supply water for input to the coil of copper tubing. Moreover, there was yet another line that was used to provide cold water to the commercial or residential building. Moreover, there also was difficulty in obtaining hot water at the proper temperature for use in commercial or residential building as output from the outlet of the copper tubing. There also was a need for an additional mixing system to control the temperature of the hot water. This mixing system required its own source of cold water that would be used to mix with the hot water.

There have been various types of manifolds that have been used for handling water and, in some cases, hot water. These manifolds have been associated with faucets, shower heads, tub-shower diverters, heating supply systems, and water valve assemblies to name a few. Although, some of these manifolds have multiple outputs, they were not associated with a boiler system such that it will receive a single feed input, and supply make-up feedwater to the pressure vessel, supply water for the copper tubing for heating, and supply water for mixing with the output from the copper tubing outlet to obtain hot water in the desired temperature range. Moreover, these manifolds were not operated to maintain the pressure in the manifold at a desired level. It would be desirable to have a manifold with these features.

SUMMARY OF THE INVENTION

The present invention is a manifold system for distributing fluid from a single source to multiple locations. The manifold system of the present invention receives a single source of a fluid, such as water, which then is used for multiple purposes. The manifold system has an inlet structure for receiving water from a single source, an outlet structure to the provided water at a desired pressure to a pressure vessel for make-up feedwater, a structure that includes a mixer that provides hot water at a desired temperature range, a second outlet structure that provides water at a predetermined pressure to water heating system, which may include a heating coil that provides an input to the mixer, and a safety device that monitors the pressure in the manifold.

The mixer receives as an input the hot water from the outlet of the heating coil. The hot water from the heating coil is mixed with cold water from within the manifold in the correct proportions to produce hot water within a desired temperature range.

The outlet structure that provides make-up feedwater at a desired pressure to the pressure vessel includes an in-line member to prevent the output flow of water in that line from backflowing and an in-line pressure control member to control the pressure of the water output from this output structure.

An object of the present invention is to provide manifold system that can be used for multiple functions in handling a single input fluid stream.

Another object of the present invention is to provide a manifold system that may be used with a boiler system for providing heated and non-heated water to a residence or commercial building.

Another object of the present invention is to provide a manifold system that may be used with a boiler system for providing heated and non-heated water at desired temperatures and pressures to a residence or commercial building.

These and other objects of the present invention will be discussed in detail in the remaining portions of the specification referring to the drawings.

DETAILED DESCRIPTION OF THE DRAWINGS

The present invention is a manifold system for distributing fluid from a single source to multiple locations. The present invention is a manifold system for providing water at desired temperatures and pressures to multiple locations.

Figure 1A:
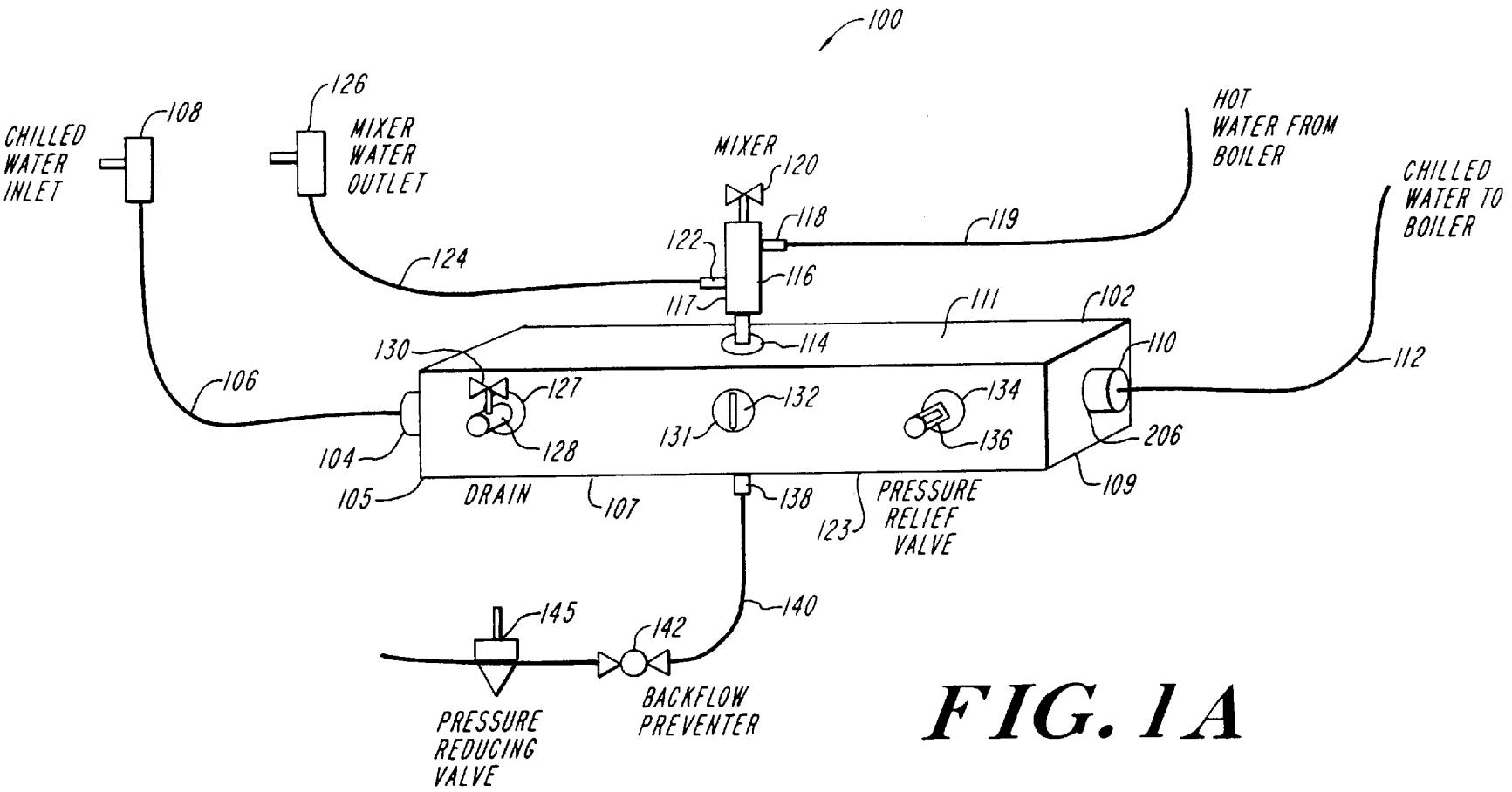
FIG. 1 A is a top perspective view of the manifold system of the present invention.
FIG. 1B shows a top perspective view of a second embodiment of the manifold system of the present invention.
Figure 2:
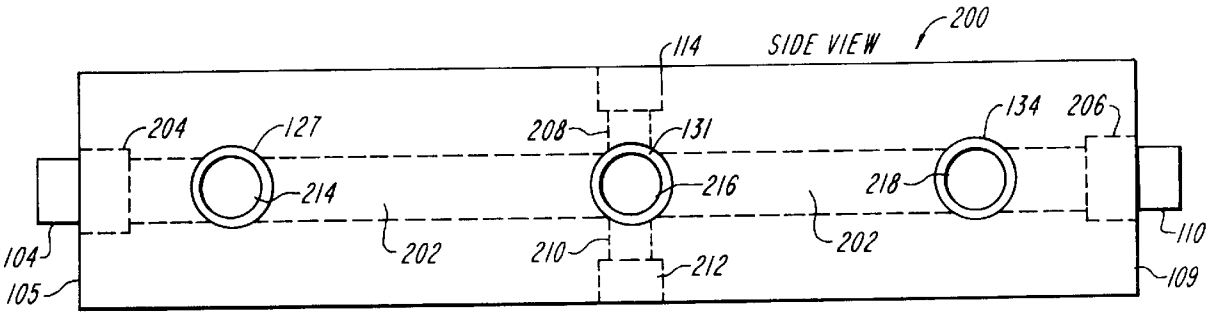
FIG. 2 is side view of the manifold body of the manifold system of the present invention with the passages and connection openings shown.
Figure 3:
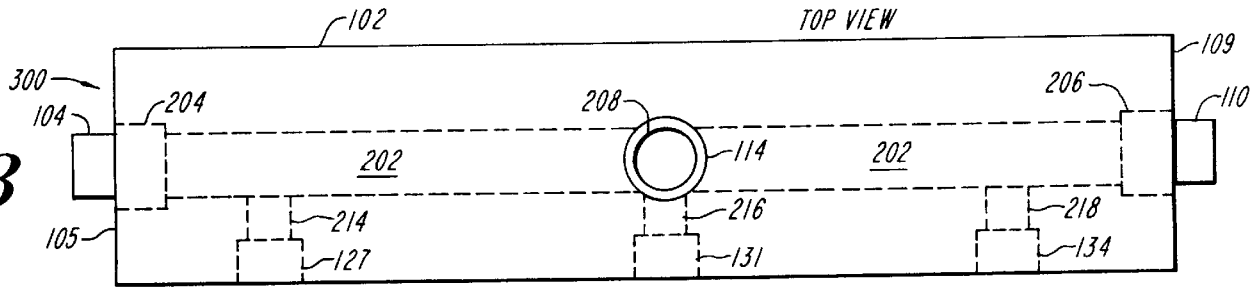
FIG. 3 is top view of the manifold body of the manifold system of the present invention with the passages and connection openings shown.
Figure 4:
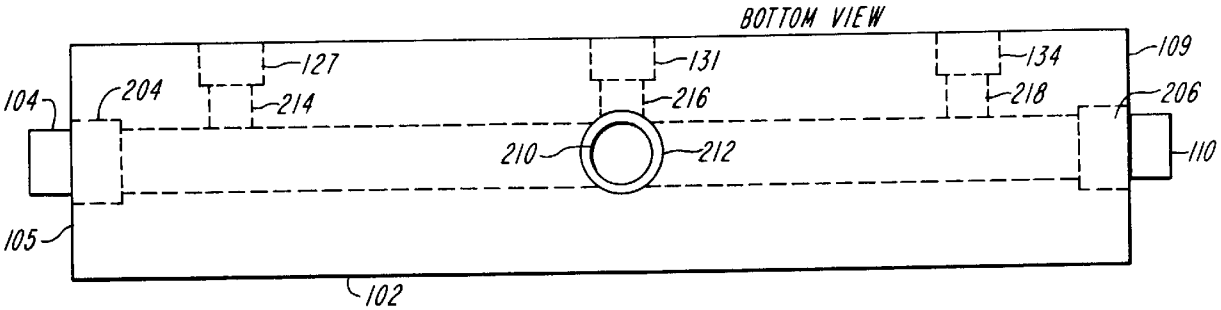
FIG. 4 is bottom view of the manifold body of the manifold system of the present invention with the passages and connection openings shown.

Referring to FIG. 1A, the manifold system of the present invention is shown generally at 100. Manifold system 100 includes manifold body 102 that has a pattern of passages and connection openings. The passages and connection openings are best shown in FIGS. 2, 3, and 4. The pattern of passages and connection opening will be described in detail in discussing FIGS. 2, 3, and 4.

Again referring to FIG. 1A, manifold system 100 has an input structure that includes connection member 104, line 106, and valve 108. Valve 108 may be any type of valve that can be used to control the flow a fluid that is being input to manifold body 102. Preferably, the fluid that is being input to manifold body 102 is water. However, it is understood that fluids other than water may be input and distributed by the manifold system of the present invention. If water is the fluid that is being distributed by the manifold system of the present invention, valve 108 may be a ball valve model FBVS-1 that is manufactured by Watts Regulator Company, Andover, Mass. It is within the scope of the present invention that the ball valve or other type of valve that may be used may be opened and closed manually or automatically.

Line 106, which connects between valve 108 and manifold body 102, preferably, is hollow rigid tubing that also has some degree of flexibility. Preferably, the line 106 is made of copper. This line also may be constructed of accordioned copper or other metal tubing, of wire mesh covered plastic or other type of resin tubing, or of a plastic or other type of resin tubing. A requirement of line 106, however, is that it should be inert to the fluid that is being input to manifold body 102.

The end of line 106 that connects to manifold body 102 has connection member 104 connected to it. Connection member 104 is in fluid communications with the passages within manifold body 102 through end 105 of the manifold body. Preferably, connection member 104 has a threaded male end that is used for securing line 106 to connection opening 204 (FIG. 2) in manifold body 102. Connection member 104 connects to manifold body 102 in a fluid tight relationship. Although the preferred connection member is the male connection member that has been described, it is understood that connection member 104 may have other configurations and still be within the scope of the present invention as long as connection member 104 will mate with connection opening in manifold body 102.

Side 107 of manifold body 102 has three connection openings in it. These are connection openings 127, 131, and 134. Although only three connection openings are shown, it is within the scope of the present invention that there may be more or less than three connection openings in side 107 of the manifold body.

Connection opening 127 preferably is a female threaded opening that is adapted to receive a male threaded member. However, it is understood that connection opening 127 may be a male connection member to which a female connector will attach or other type of connection structure and still be within the scope of the present invention.

Drain structure 128 is connected to connection opening 127. Drain structure 128 has a male threaded section that is adapted to mate with connection opening 127 in a fluid tight relationship. Drain structure 128 has a control handle that is used to manually control the drainage of fluid from within manifold body 102, when desired. Although the drain structure that is shown is controlled manually, it is understood that the drain structure may also be controlled automatically and still be within the scope of the present invention.

Connection opening 131 in side 107 of manifold body 102 preferably is a female threaded opening that is adapted to receive a male threaded member. However, it is understood that connection opening 131 may be a male connection member to which a female connector will attach or other type of connection structure and still be within the scope of the present invention.

Connection opening 131 that is shown in the side of manifold body 102 is not being use. As such, removable plug 132 is inserted in this connection opening. Plug 132 has a male threaded section that is adapted to mate with connection opening 131 in a fluid tight relationship. If it was desired to be used, the appropriate fixture would be connected to connection opening 131.

The third connection opening in side 107 of manifold body 102 is connection opening 134. This connection opening, like the two previously described, preferably is a female threaded opening that is adapted to receive a male threaded member. However, it is understood that connection opening 134 may be a male connection member to which a female connector will attach or other type of connection structure and still be within the scope of the present invention.

Connected to connection opening 134 is pressure relief valve 136. Pressure relief valve 136 has a male threaded section that is adapted to mate with connection opening 134 in a fluid tight relationship. The pressure relief valve operates conventionally and will lift if the pressure within manifold body 102 becomes higher than the pressure setting for the pressure relief valve. Preferably, pressure relief valve 136 is model 53L that is manufactured by Watts Regulator Company.

End 109 of manifold body 102 has connection opening 206 disposed in it. Connection opening 206, preferably, is a female threaded opening that is adapted to receive a male threaded member. However, it is understood that connection opening 134 may be a male connection member to which a female connector will attach or other type of connection structure and still be within the scope of the present invention.

Output line 112 is connected to connection opening 206 by connection member 110. Output line 112, preferably, is hollow rigid tubing that also has some degree of flexibility. Preferably, line 112 is made of copper. This line also may be constructed of accordioned copper or other metal tubing, of wire mesh covered plastic or other type of resin tubing, or of a plastic or other type of resin tubing. A requirement of line 112, however, is that it should be inert to the fluid that is being processed by the manifold system of the present invention. Preferably, output line 112 provide cold water to a boiler for heating.

As stated, output line 112 connects to manifold body 102 via connection member 110. Connection member 110 is in fluid communications with the passages within manifold body 102 through connection opening 206 in the manifold body. Preferably, connection member 110 has a threaded male end that is used for securing line 112 to connection opening 206. Connection member 110 connects to connection opening 206 in a fluid tight relationship. Although the preferred connection member is the male connection member that has been described, it is understood that connection member 110 may have other configurations and still be within the scope of the present invention as long as connection member 110 will mate with desired connection opening of manifold body 102.

Top 111 of manifold body 102 has connection opening 114 disposed in it. Connection opening 114, preferably, is a female threaded opening that is adapted to receive a male threaded member. However, it is understood that connection opening 114 may be a male connection member to which a female connector will attach or other type of connection structure and still be within the scope of the present invention.

Mixer structure 116 is connected to manifold body 102 at connection opening 114. Mixer 116 has a male threaded section that is adapted to mate with connection opening 114 in a fluid tight relationship. Mixer structure 116 has mixer body 117, in-flow connector 118, in-flow line 119, out-flow connector 112, out-flow line 124, valve 108, and control handle 120. Mixer body 117 is in fluid communication with the passages in manifold body 102, and in-flow line 119 and out-flow line 124. Mixer body 117 with in-flow connector 118, out-flow connector 122, and control handle 120 are preferably model 70A manufactured by Watts Regulator Company, Andover, Mass.

In-flow line 119 connects to in-flow connector 118 to connect the inflow line to mixer body 117. In-flow line 119, preferably, connects to a hot water line output from a boiler. Also, preferably, in-flow line 119 is made of copper. This line also may be constructed of accordioned copper or other metal tubing, of wire mesh covered plastic or other type of resin tubing, or of a plastic or other type of resin tubing. A requirement of line 119 is that it should be inert to the fluid that is being processed by the manifold system.

Out-flow line 124 connects to out-flow connector 122 to connect the out-flow line to mixer body 117. The opposite end of out-flow line 124 connects to valve 126. Preferably, out-flow line 124 is made of copper. Further, this line may be constructed of accordioned copper or other metal tubing, of wire mesh covered plastic or other type of resin tubing, or of a plastic or other type of resin tubing. A requirement of line 124 is that it should be inert to the fluid that is being processed by the manifold system.

Valve 126 may be any type of valve that an be used to control a fluid that is being output from mixer body 117. Valve 108 may be a ball valve model FBVS-1 that is manufactured by Watts Regulator Company, Andover, Mass. However, other types of valves may be used and still within the scope of the present invention. Whether a ball valve or other type of valve is used, that valve preferably should be capable of being open and closed either manually or automatically.

Mixer body 117 also has control handle 120 disposed on it to control the mixing, for example, cold water from manifold body 102 and the hot water from in-flow line 119 to provide water at a desired temperature in out-flow line 124. Control handle 120 controls the proportions of the cold and hot water that are mixed in the mixer body. Although mixer body 117 is shown with manual control handle 120, it is understood that mixing can be controlled automatically and still be within the scope of the present invention.

Figure 1B:
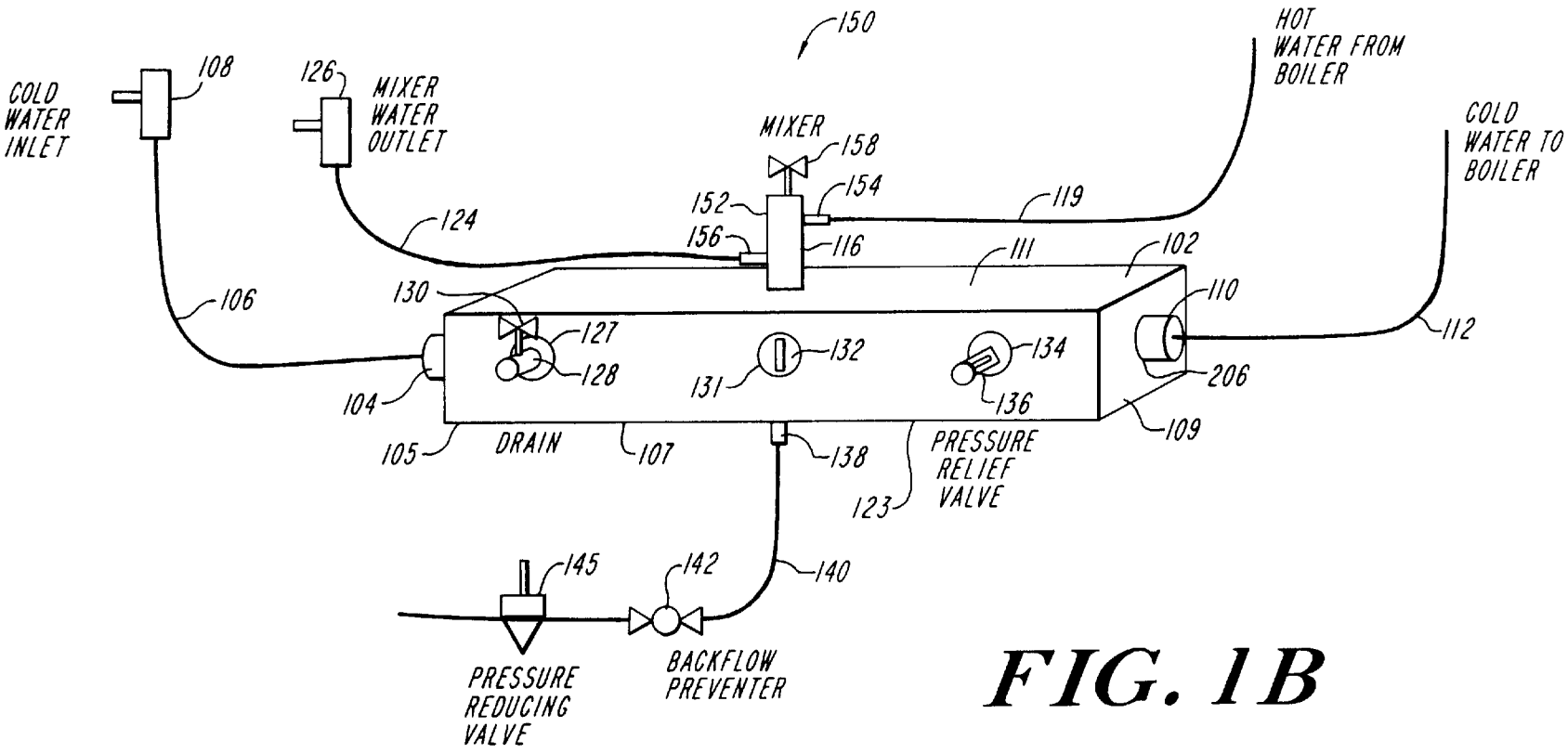

Referring to FIG. 1B, a second embodiment of the invention is shown gernally at 150. The second embodiment is substantially the same as the first embodiment, except that instead of mixer body 117 being connected to manifold body 102, in this embodiment mixer body 152 which is intergrally formed with a manifold body 102. Mixer body 152 is in fluid communcation with the passages within manifold body 102. Mixer body 152 has in-flow connector 154 and out-flow connector 156 that connect to in-flow line 119 and out-flow line 124, respectively. Mixer body 152 also has control handle 158, which is to control the proportions of the fluids being mixed. The mixer structures of the first and second embodiments of the present inventions operate substantially the same.

Bottom 123 of manifold 102 has connection opening 212 (FIG. 2) disposed in it. Connection opening 212, preferably, is a female threaded opening that is adapted to receive a male threaded member. However, it is understood that connection opening 212 may be a male connection member to which a female connector will attach or other type of connection structure and still be within the scope of the present invention.

Output line 140 is connected to opening 212 by connection member 138. Output line 140 preferably is hollow rigid tubing that also has some degree of flexibility. Preferably, the line 140 is made of copper. This line also may be constructed of accordioned copper or other metal tubing, of wire mesh covered plastic or other type of resin tubing, or of a plastic or other type of resin tubing. A requirement of line 140, however, is that it should be inert to the fluid that is being processed by the manifold system. Preferably, output line 140 provides make-up feedwater to a boiler.

Output line 140 includes backflow preventer 142 for preventing the backflow of water in line 140. After backflow preventer, pressure reducing valve 144 is disposed in line 140. Pressure reducing valve 144 controls the amount of pressure in the fluid flow in line 140. Preferably, the backflow preventer is model 9D manufactured by Watts Regulator Company, Andover, Mass. and the pressure reducing valve is model 1156 manufactured by Watts Regulator Company, Andover, Mass.

As stated, output line 140 connects to manifold body 102 via connection member 138. Connection member 138 is in fluid communications with the passages within manifold body 102 through connection opening 212 in the manifold body. Preferably, connection member 138 has a threaded male end that is used for securing line 140 to manifold body 102. Connection member 138 connects to manifold body 102 in a fluid tight relationship. Although the preferred connection member is the male connection member that has been described, it is understood that connection member 138 may have other configurations and still be within the scope of the present invention as long as connection member 138 will mate with desired connection opening in the manifold body 102.

Referring to FIGS. 2, 3, and 4, the interior passages and connection opening will be described in detail. FIG. 2 is a side view of manifold body 102, FIG. 3 is a top view of the manifold body, and FIG. 4 is a bottom view of the manifold body. Manifold body 102 may be made of any suitable material. Preferably, manifold body 102 is made from a non-ferrous material, e.g., bronze, brass, red-brass, copper or stainless steel.

Manifold body 102 has central passage 202. Central passage 202 has female connection opening 204 at end 105 and female connection opening 206 at end 109. As is shown, male connection member 104 is disposed in connection opening 204 and male connection member 110 is disposed in connection opening 206.

Referring particularly to FIG. 2, passages 208 and 210 are in fluid communications with central passage 202 and disposed perpendicular to the central passage in opposite directions. Passage 208 connects to connection opening 114 that receives the male section of mixer body 117. Passage 210 connects to connection opening 212 that receives the male section of connection member 138.

Referring particularly to FIGS. 3 and 4, passages 214, 216, and 218 are in fluid communications with central passage 202 and disposed perpendicular to the central passage in the same direction. Passage 214 connects to connection opening 127 that receives the male section of drain structure 128. Passage 216 connects to connection opening 131 that receives the male section of plug 132. Passage 218 connects to connection opening 134 that receives the male section of pressure relief valve 136.

Figure 5:
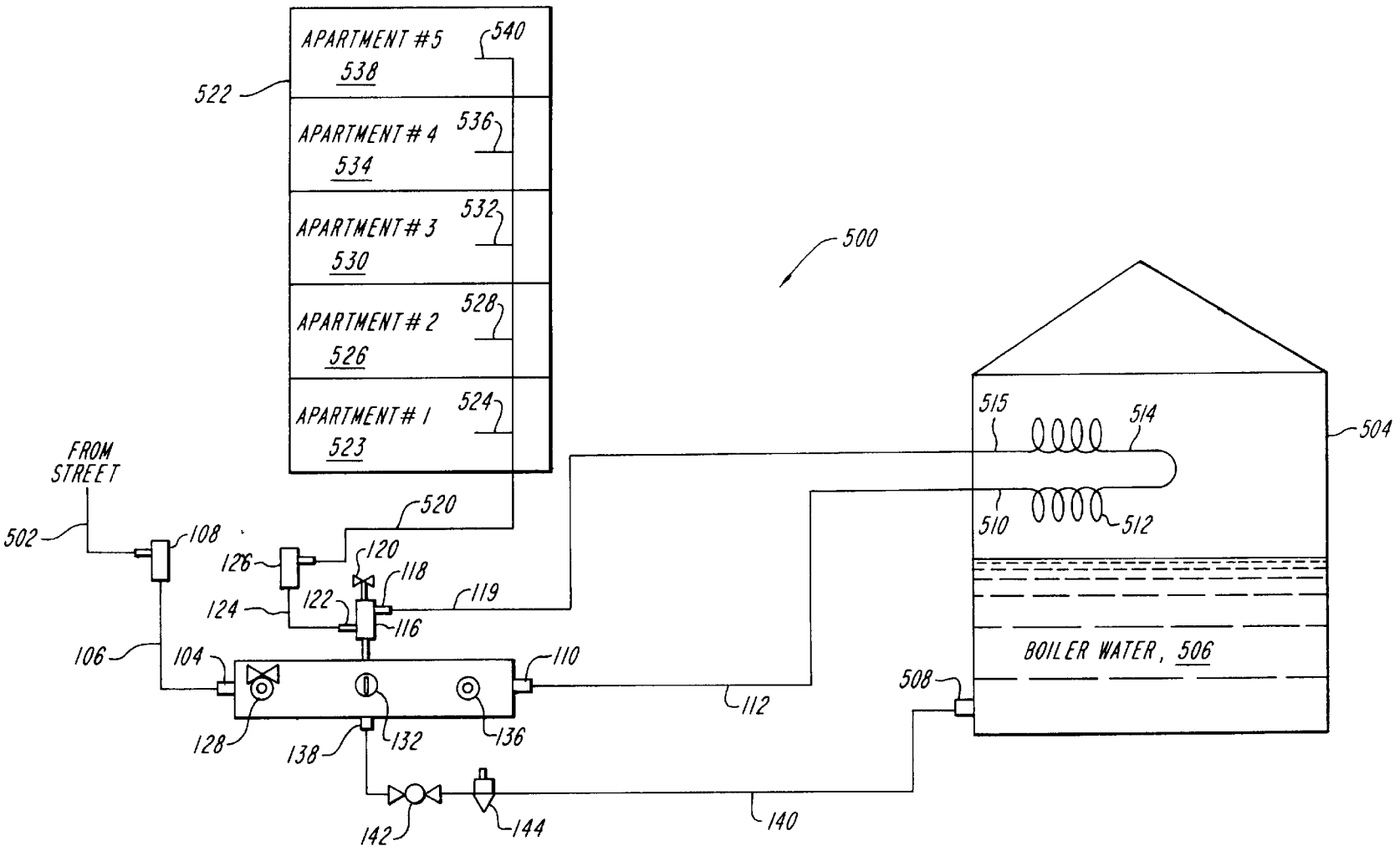
FIG. 5 shows the manifold system of the present invention as it is used to provide water for multiple purposes.

Referring to FIG. 5, the preferred operation of the manifold system of the present invention will be described. Generally at 500, the manifold system of the present invention, which includes manifold body 102; an input structure consisting of valve 108, input line 106 and connection member 104; drain structure 128; plug 132; pressure relief valve 136; an output structure consisting of connection member 110 and output line 112; a make-up feed structure consisting of connection member 138, line 140, backflow preventer 142, and pressure reducing valve 144; and a mixer structure consisting of mixer body 117 with in-flow connector 118 and in-flow line 119, and out-flow connector 112, out-flow line 124, and valve 126, is shown associated with a boiler system and apartment complex (which realizes the benefit of the present invention).

According to the operation of the present invention, water from a street or other source is provided to ball valve 108 via line 502. The water in 502 generally is at a predetermined pressure. Ball valve 108 is set so that the stream of water in line 106 will be at a predetermined maximum pressure or flow rate. The water that enters manifold body 102 from line 106 will be put to multiple uses as will be discussed.

Boiler 504 is used with the manifold system to produce hot water at a predetermined temperature and the manifold system is used to keep boiler water 506 at the proper level. Taking the later first, boiler 504 has a sensor (not shown) that is used to sense or show the level of the boiler water. It is necessary to keep the boiler at the proper level to prevent serious damage to the boiler.

Water, at a predetermined pressure, is output to line 140 from manifold body 102 via connection member 138. Backflow preventer 142 prevents water that passes this point in line 140 from flowing back to the manifold body. If this were not the case, there is a distinct probability that boiler water 506 could by backed-up into the manifold body which could be very dangerous. Pressure reducing valve 144 in line 140 ensures that the pressure of the water in line 140 will be at a proper pressure level.

Line 140 connected to boiler 504 at pump 508. When the level of boiler water 506 is low and make-up feedwater is required, the sensor in the boiler 504 senses this condition and energizes pump 506 that will pump make-up feedwater into the boiler until the proper level for the feedwater is reached. At this point, pump 508 is turned off. It is understood that pump 508 can be operated manually or automatically, and the sensor may be one that is visually sighted, like a sight glass, or some type of electronic sensor.

If it is desired to drain water from the manifold system to test it or for some other use, drain structure 128 is used. Further, if for some reason the pressure in manifold body becomes too high, pressure relief valve 136 will lift appropriately to ensure the proper pressure in the manifold body is maintained.

The water output from manifold body 102 through connection member 110 into line 112 is to be used for producing hot water. The water in line 112 is input to coils 512 and 514 in loop line 510 in boiler 504. As the water passes through these coils, it is heated by saturated or superheated steam. This will result in extremely hot water being provided in line 119. The water in line 119 is too hot for domestic use.

The hot water in 119 is input to mixer body 117. Also input to mixer body 117 is the cold water from manifold body 102. Depending on the proportions of the hot and cold water that are mixed, water at a predetermined temperature is output into line 124. The temperature of the mixed water will be in a range that makes it domestically usable.

The water in line 124 is input to ball valve 126 which will control the pressure or flow rate of the water output in line 520. Line 520, for example, connects to apartment building 522 for the purpose of providing hot water to Apartments #1–5. As is shown, line 524 connects to line 520 to provide hot water to Apartment #1, 523; line 528 connects to line 520 to provide hot water to Apartment #2, 526; line 532 connects to line 520 to provide hot water to Apartment #3, 530; line 536 connects to line 520 to provide hot water to apartment #4, 534; and line 540 connects to line 520 to provide hot water to Apartment #5, 538. This is applicable to not only apartments, but to other types of commercial or residential buildings that use hot water. Further, the present invention may be used for fluids other than water and for other uses.

The terms and expressions which are used herein are used as terms of expression and not of limitation. There is no intention in the use of such terms and expressions of excluding the equivalents of the features shown and described, or portions thereof, it being recognized that various modifications are possible in the scope of the present in the scope of the present invention.

I claim:

1. A unitary manifold system for distributing a fluid that is connected to a processing structure, comprising:

a central body having a plurality of internal passages for receiving, outputting, and directing fluid;

a first input structure that is connected to the central body and in fluid communications with at least one passage in the central body, with the first input structure having a first flow control member for controlling a rate of flow of fluid through the first input structure to the central body;

a first output structure that is connected to the central body and in fluid communications with at least one passage in the central body, with the first output structure having a one- way flow member associated therewith to permit the flow fluid in the first output structure in a direction away from the central body;

a second output structure that is connected to the central body and in fluid communications with at least one passage in the central body, with the second output structure providing an output to a property changing member that will change at least one property of the fluid output from the second output structure; and said processing structure that is connected to the central body and in fluid communications with at least one passage in the central body, and connected to the property changing member, with the processing structure further having an in-flow fluid line for receiving fluid from the property changing member after at least one property has been changed, a processing member for processing the fluid with at least one property change with fluid from the central body that does not have art least one property changed, an out-flow fluid line to output processed fluid, and a second flow control member for controlling a rate of flow of processed fluid output from the out-flow line.

2. A unitary manifold system for distributing a fluid that is connected to a processing structure, comprising:

a central body having a plurality of internal passages for receiving, outputting, and directing fluid;

a first input structure that is connected to the central body and in fluid communications with at least one passage in the central body, with the first input structure having a first flow control member for controlling a rate of flow of fluid through the first input structure to the central body;

a first output structure that is connected to the central body and in fluid communications with at least one passage in the central body, with the first output structure having a one-way flow member associated therewith to permit the flow fluid in the first output structure in a direction away from the central body;

a second output structure that is connected to the central body and in fluid communications with at least one passage in the central body, with the second output structure providing an output to a property changing member that will change at least one property of the fluid output from the second output structure; and said processing structure that is intergrally formed with the central body and in fluid communications with at least one passage in the central body, and connected to the property changing member, with the processing structure further having an in-flow fluid line for receiving fluid from the property changing member after at least one property has been changed, a processing member for processing the fluid with at least one property change with fluid from the central body that does not have art least one property changed, an out-flow fluid line to output processed fluid, and a second flow control member for controlling a rate of flow of processed fluid output from the outflow line.

3. The unitary manifold system as recited in claim 1, wherein the first input structure includes a first inlet line and the first flow control member, the first flow control member includes a first valve.

4. The unitary manifold system as recited in claim 1, wherein the first output structure includes a first output line and an one-way flow member, the one-way flow member includes backflow preventer.

5. The unitary manifold system as recited in claim 3, wherein the first output structure further includes a pressure reducing valve disposed across the first output line to reduce the pressure in the first output line a predetermined amount.

6. The unitary manifold system as recited in claim 3, the second output structure includes a mixer that is used to increase temperature of a first flow of fluid through the mixer from the manifold by mixing the first flow with a second flow of fluid through the mixer from source of heated fluid.

7. The unitary manifold system as recited in claim 5, wherein the source of heated fluid includes the processing structure.

8. The unitary manifold system as recited in claim 1, wherein the processing structure include a boiler.

9. The unitary manifold system as recited in claim 3, the processing structure includes a boiler.

10. A manifold system for distributing a fluid, comprising:

a central body having a plurality of internal passages for receiving, outputting, and directing fluid;

a first input structure that is connected to the central body and in fluid communications with at least one passage in the central body, with the first input structure having a first flow control member for controlling a rate of flow of fluid through the first input structure to the central body;

a first output structure that is connected to the central body and in fluid communications with at least one passage in the central body, with the first output structure having a one-way flow member associated therewith to permit the flow fluid in the first output structure in a direction away from the central body;

a second output structure that is connected to the central body and in fluid communications with at least one passage in the central body, with the second output structure providing an output to a property changing member that will change at least one property of the fluid output from the second output structure; and a processing structure that is intergrally formed with the central body and in fluid communications with at least one passage in the central body, and connected to the property changing member, with the processing structure further having an in-flow fluid line for receiving fluid from the property changing member after at least one property has been changed, a processing member for processing the fluid with at least one property change with fluid from the central body that does not have art least one property changed, an out-flow fluid line to output processed fluid, and a second flow control member for controlling a rate of flow of processed fluid output from the out-flow line.

11. The system as recited in claim 1, wherein the fluid includes water.

12. The system as recited in claim 1, wherein the first flow control member of the first input structure includes a valve.

13. The system as recited in claim 12, wherein the first input structure further includes a first connection member for connecting the first input structure to the central body.

14. The system as recited in claim 12, wherein the first input structure further includes tubing that connects between the valve and the first connection member.

15. The system as recited on claim 13, wherein the one-way flow member includes a backflow preventer.

16. The system as recited in claim 15, wherein the first output structure includes a second connection member for connecting the first output structure to the central body.

17. The system as recited in claim 16, wherein the first output structure further includes a pressure control member for controlling the pressure of the fluid output from the first output structure.

18. The system as recited in claim 17, wherein the first output structure further includes tubing that connects to the second connection member, with the tubing having the backflow preventer and pressure control member disposed thereon.

19. The system as recited in claim 15, wherein the second output structure includes a third connection member for connecting the second output structure to the central body.

20. The system as recited in claim 19, wherein the second output structure further includes tubing that connects to the third connection member.

21. The system as recited in claim 20, wherein the processing structure includes a mixer that is in fluid communications with at least one passage on the central body, with the mixer having at least a first input for connection to the in-flow line and a first output for connection to the out-flow line.

22. The system as recited in claim 21, the property change member includes a heat exchanger that transfers heat to the fluid output from the second out structure.

23. The system as recited in claim 22, wherein the in-flow fluid line includes tubing.

24. The system as recited in claim 22, wherein the out-flow fluid line includes tubing.

25. The system as recited in claim 22, wherein the mixer is controlled by a control member, with the control member controlling mixing proportions in the mixer.

26. The system as recited in claim 25, wherein the second flow control member includes a valve.

27. The system as recited in claim 25, wherein the system further includes a drain member connected to the central body and in fluid communications with at least one passage of the central body.

28. The system as recited in claim 26, wherein the system further includes a pressure relief member for relieving pressure within the central body, with the pressure relief member being in fluid communications with at least on passage of the central body.

* * * * *